US007222576B2

(12) United States Patent
Kilgore

(10) Patent No.: US 7,222,576 B2
(45) Date of Patent: May 29, 2007

(54) GATE APPARATUS FOR TUFTING LOOP AND CUT PILE STITCHES

(75) Inventor: Michael Kilgore, Whitwell, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

(21) Appl. No.: 11/347,540

(22) Filed: Feb. 3, 2006

(65) Prior Publication Data

US 2006/0225630 A1 Oct. 12, 2006

Related U.S. Application Data

(60) Provisional application No. 60/649,505, filed on Feb. 3, 2005.

(51) Int. Cl.
*D05C 15/22* (2006.01)
*D05B 57/00* (2006.01)

(52) U.S. Cl. ..... 112/80.5

(58) Field of Classification Search ..... 112/80.5–80.6; 74/10 R–10.37; 235/12; 403/230; 267/166.1
See application file for complete search history.

(56) References Cited

U.S. PATENT DOCUMENTS

| | | | | | |
|---|---|---|---|---|---|
| 2,260,599 | A | * | 10/1941 | Benton et al. | 74/10.33 |
| 2,990,792 | A | * | 7/1961 | Nowicki et al. | 112/80.52 |
| 3,812,799 | A | * | 5/1974 | Spanel et al. | 112/80.07 |
| 4,111,407 | A | * | 9/1978 | Stager | 267/166.1 |
| 4,194,403 | A | * | 3/1980 | Santoro | 74/10.33 |
| 4,314,347 | A | | 2/1982 | Stokely | |
| 4,353,317 | A | | 10/1982 | Crumbliss | |
| 4,466,366 | A | * | 8/1984 | Hirotsu | 112/80.56 |
| 6,155,187 | A | | 12/2000 | Bennett et al. | |
| 7,007,617 | B2 | * | 3/2006 | Johnston | 112/80.51 |
| 2005/0109253 | A1 | | 5/2005 | Johnston | |

* cited by examiner

*Primary Examiner*—Ismael Izaguirre
(74) *Attorney, Agent, or Firm*—Douglas T. Johnson

(57) ABSTRACT

A gated looper apparatus has an array of individually mounted pressurizable air cylinders with piston rods acting against biased slider bars in communication with looper gates. Baising elements are mounted external of pneumatic cylinders about slider bars with protective ferules to provide greater responsiveness and ease of maintenance.

20 Claims, 11 Drawing Sheets

GATE APPARATUS FOR TUFTING LOOP AND CUT PILE STITCHES

RELATED U.S. APPLICATION DATA

This application claims the benefit of U.S. Provisional Application No. 60/649,505 filed Feb. 3, 2005 which is incorporated herein by reference.

FIELD OF THE INVENTION

The present invention relates to the manufacture of tufted fabrics, and particularly to an improved gate apparatus to allow a looper to tuft either loop pile or cut pile stitches.

BACKGROUND OF THE INVENTION

In the field of tufting, there have been a variety of efforts made to enable both cut pile and loop pile tufts or bights of yarn to be placed in the same row of stitches. In some instances, the structures utilized for this purpose did not allow effective control of the height of stitches and, for instance, the cut pile stitches might always be of greater height than the loop pile stitches. The use of pivoting gate structures on the loopers was proposed in Jolley, U.S. Pat. No. 4,134,347 and Crumbliss, U.S. Pat. No. 4,353,317.

Later sliding gate structures were proposed as typified by Bennett, U.S. Pat. No. 6,155,187. When properly implemented, sliding gate structures may provide rapid response and avoid moving the entire pneumatic activation assembly with the loopers. However, Bennett taught the use of internal biasing elements in pneumatic cylinders and the use of blocks of cylinders to improve efficiencies in assembly. In practice, the use of internal biasing elements limits the size and corresponding force that the biasing elements may provide. In turn, this limits the speed with which the gate can return to the open position after pressure to its corresponding pneumatic cylinder is stopped. Furthermore, the internal biasing elements are not visible to inspection and if rust beings to form due to moisture in the cylinder, for instance, there will be no way to detect the problem until performance degrades to the point where defective carpet patterns are produced, with resulting waste carpet and the need to replace an entire cylinder block rather than merely a spring or biasing element.

Finally, it is desirable to assemble the pneumatic cylinders used to operate the gates in a tight array to permit their use with fine gauge tufting machines. Constructing the cylinders in arrays of removable cylinders stacked four high in nearly vertical columns and designing corresponding gate structures permits this density to be achieved.

SUMMARY OF THE INVENTION

Therefore, it is a primary object of the invention to provide an improved sliding gate structure for use in tufting both loop pile and cut pile stitches from yarns seized by the same looper.

It is another object of the invention to provide a pneumatically activated sliding gate structure with external biasing means to return the gates to their open and unactivated positions.

It is yet another object of the invention to provide discrete pneumatic cylinders and biasing means so that a defective element may be replaced without the need for replacing an entire module or block of components.

It is still a further object of the invention to provide an array of pneumatic cylinders and corresponding activated sliding gates in a compact form so as to be effectively employed with narrow gauge needle configurations according to the present invention.

BRIEF DESCRIPTION OF THE DRAWINGS

The particular features and objects of the invention as well as other advantages will be appreciated from the following description in connection with the drawings of an embodiment of the invention in which.

DETAILED DESCRIPTION OF THE INVENTION

Figure 1:
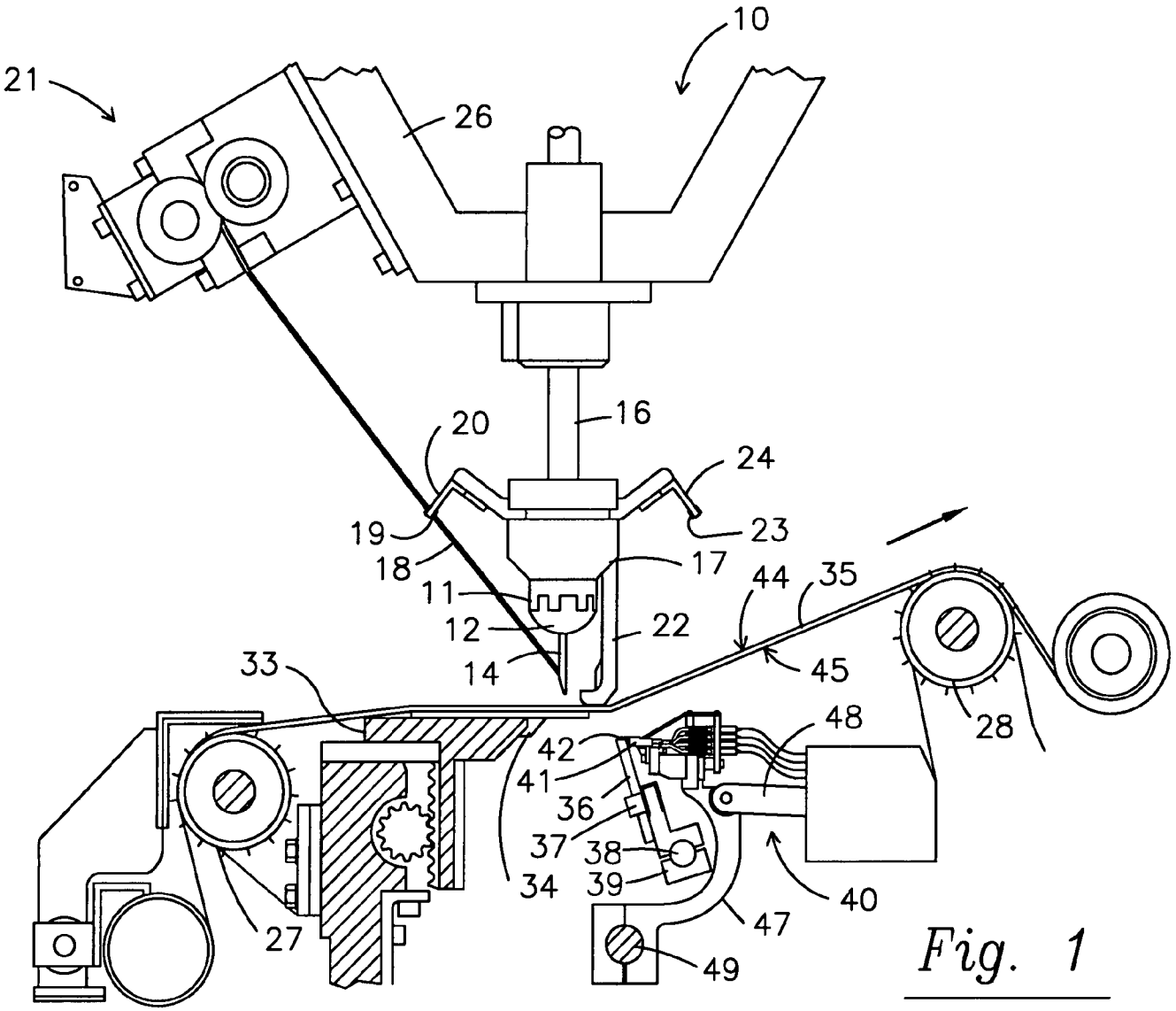
FIG. 1 is a sectional end view of a multiple needle tufting machine constructed for use with the sliding gate assembly of the present invention.

FIG. 1 discloses a tufting machine 10 including transversely supported needle bar 12 which in turns supports a row of transversely spaced needles 14. The needle bar carrier 11 is connected to push rod 16 adapted to be vertically reciprocated by a conventional needle drive mechanism, not shown. Front yarns 18 are supplied to the needles 14 through apertures 19 in the front yarn guide plate 20 from a source of yarn supply, not shown, such as yarn feed rolls, creels, or other known yarn supply means. Preferably the front yarns pass through a yarn feed pattern control mechanism 21 adapted to feed the appropriate length of individual yarns 18 to corresponding needles 14 in accordance with a pre-determined pattern. Any one of several pattern control mechanisms may be incorporated in the mechanism 21 such as those disclosed in U.S. Pat. Nos. 6,244,203 and 6,283,053, or earlier mechanisms, and typically attach to the head 26 of tufting machine 10.

When needed, rear yarns may be correspondingly fed through apertures 23 in rear yarn guide plates 24 from another source or supply of yarns. If desired, the needle bar 12 may be slideably mounted and shifted by appropriate pattern control means in a well known manner, such as by cams, roller drives, or hydraulic shifters.

Supported upon a needle plate 32 and fixed to bed frame 33 are a plurality of straight rearward projecting transversely spaced needle plate fingers 34 extending between the vertical needle paths of the reciprocal needles 14. The substrate or base fabric 35 is supported for longitudinal rearward movement over the needle plate 32. The base fabric is drawn by conventional fabric feed mechanism or substrate drive such as a belt and pulley mechanism or servo motors powering spiked substrate drive rolls 27, 28.

The needle drive mechanism, not shown, is designed to actuate push rod 16 to vertically reciprocate the needle bar 12 and to cause the needles 14 to simultaneously penetrate the substrate 35 far enough to carry the yarns 18 through the substrate 35 to form loops therein. After the loops are formed, the needles 14 are vertically withdrawn to their elevated retracted position disclosed in FIG. 1.

Figure 5:
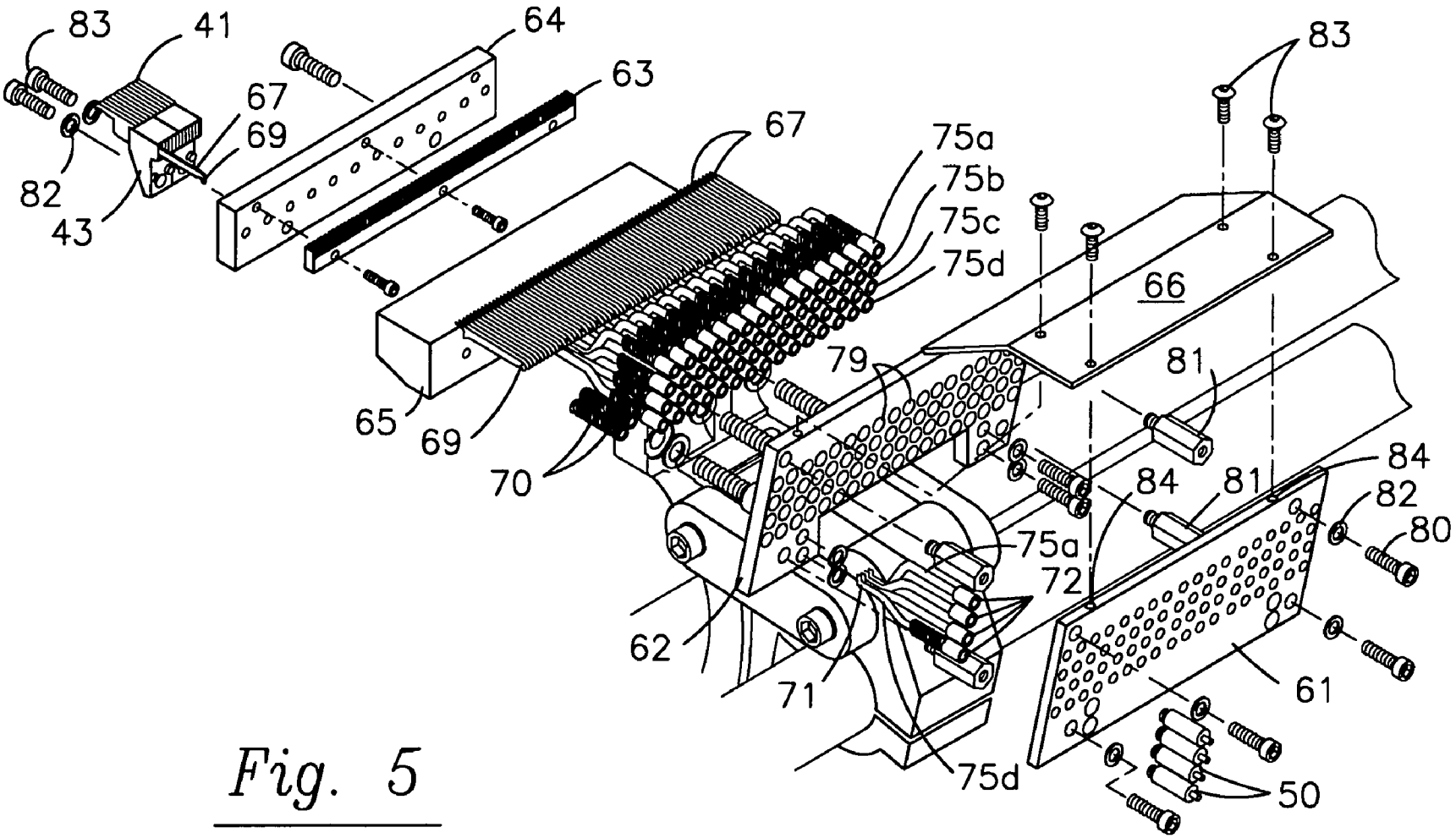
FIG. 5 is an exploded rear perspective view of an embodiment of an eighteen column array of pneumatic cylinders and corresponding gates, loopers and related gauge components.
Figure 6:
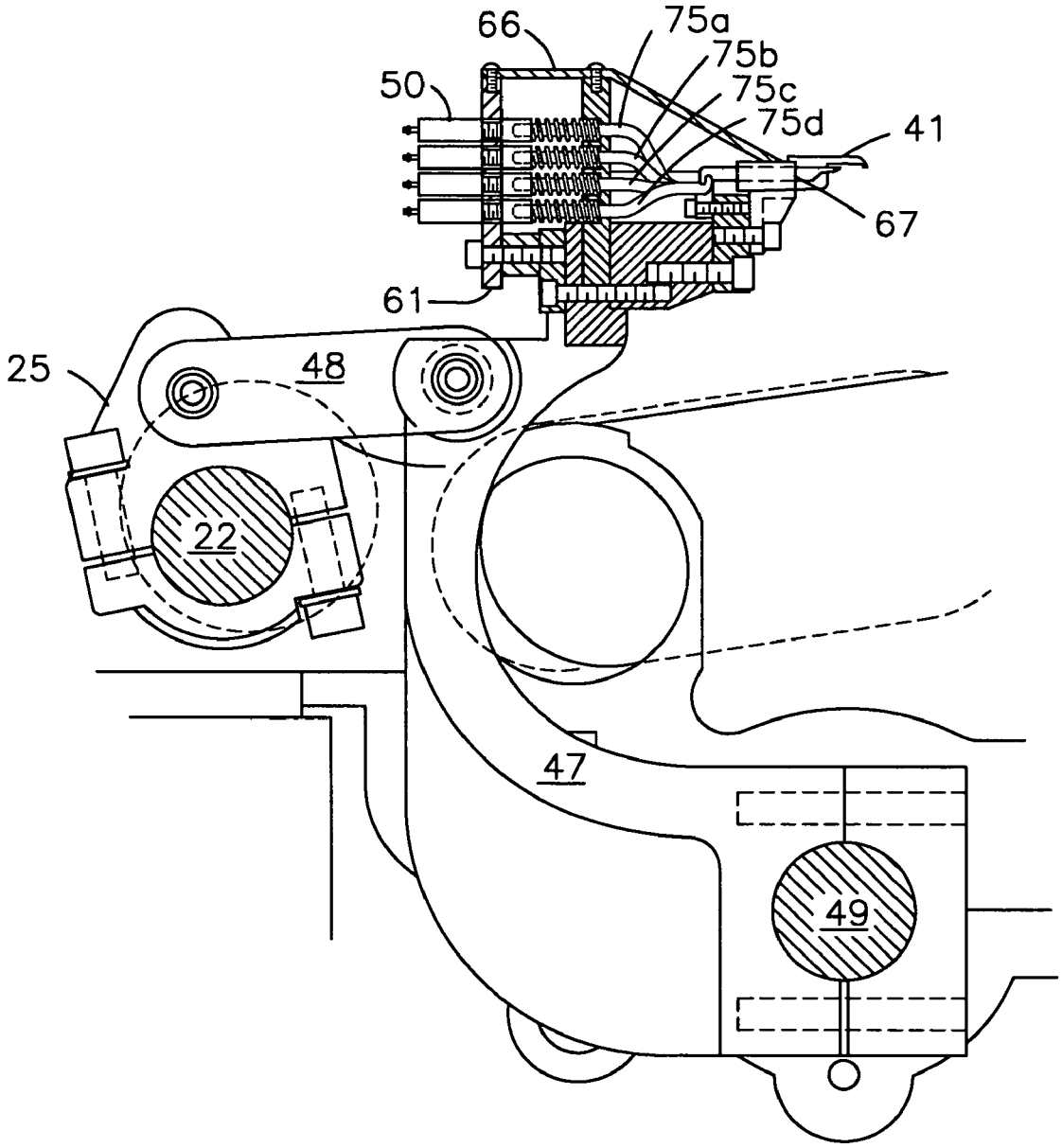
FIG. 6 is a side view of an embodiment of the invention in position on the rocker bar of a tufting machine.

A looper apparatus 40 made in accordance with the invention and shown in greater detail in FIG. 6, includes a plurality of transversely spaced hooks 41, there being at least one hook 41 for each needle 14 in the usual case. The hooks 41 are arranged so that the bill 42 of a hook 41 will cross and engage each needle 14 when the needle 14 is in its lowermost position and in a well known manner seize the yarn 18 and form a loop therein. The bills of the hooks 41 point forward opposite the direction of the fabric feed as indicated by the arrow 30. Hooks 41 are mounted in hook bars as shown in greater detail in FIGS. 3 through 6, and secured at the upper end of rocker arm 47. Any conventional means to oscillate the rocker arm 47 may be provided. In a customary embodiment, the lower end of the rocker arm 47 is clamped to laterally extending rock shaft 49. Pivotably connected to the upper portion of the rocker arm 47 is one end of a connecting link 48 having its other end pivotably connected to a jack shaft rocker arm 25 (shown in FIG. 6) mounted on a jack shaft 22 which has an oscillating motion imparted thereto by a drive means, such as a cam and lever apparatus in communication with the main drive shaft, so that the jack shaft 22 oscillates in timed relationship to the reciprocation of the needles 14. The tufting machine 10 also incorporates a plurality of knives 36 which may cooperate with the hooks to cut selected loops to form cut pile tufts or bights of yarn as hereinafter described. The knives 36 may be mounted in knife blocks 37 and then mounted to a knife shaft rocker arm 39 which is clamped to knife shaft 38. Oscillatory movement is imparted to the knife shaft 38 to conventionally drive the knives into engagement with one side of the respective hooks 41 as known in the art to provide a scissors-like cutting action.

In conventional tufting machine operation, the yarn feed pattern control mechanism 21 is programmed to feed selected yarns 18 at varying lengths in order to produce a desired high-low pattern of tufted bights of yarn. The yarns 18 can be selected from different colors or varying size or physical characteristics. Additional patterning capability may be provided by shifting the needle bar 12 as the substrate 35 moves in the direction of arrow 30 rearwardly through the machine 10. The patterns formed on the substrate 35 appear on the bottom surface 45 while the upper surface 44 of the substrate 35 contains the back stitching necessary to permit needles 14 to move from one tufting location to another. After passing through the tufting zone, the backing fabric 35 is directed under a presser foot 22 and upward away from the tufting zone to provide space for the gated looper apparatus 40 of the present invention.

Figure 2:
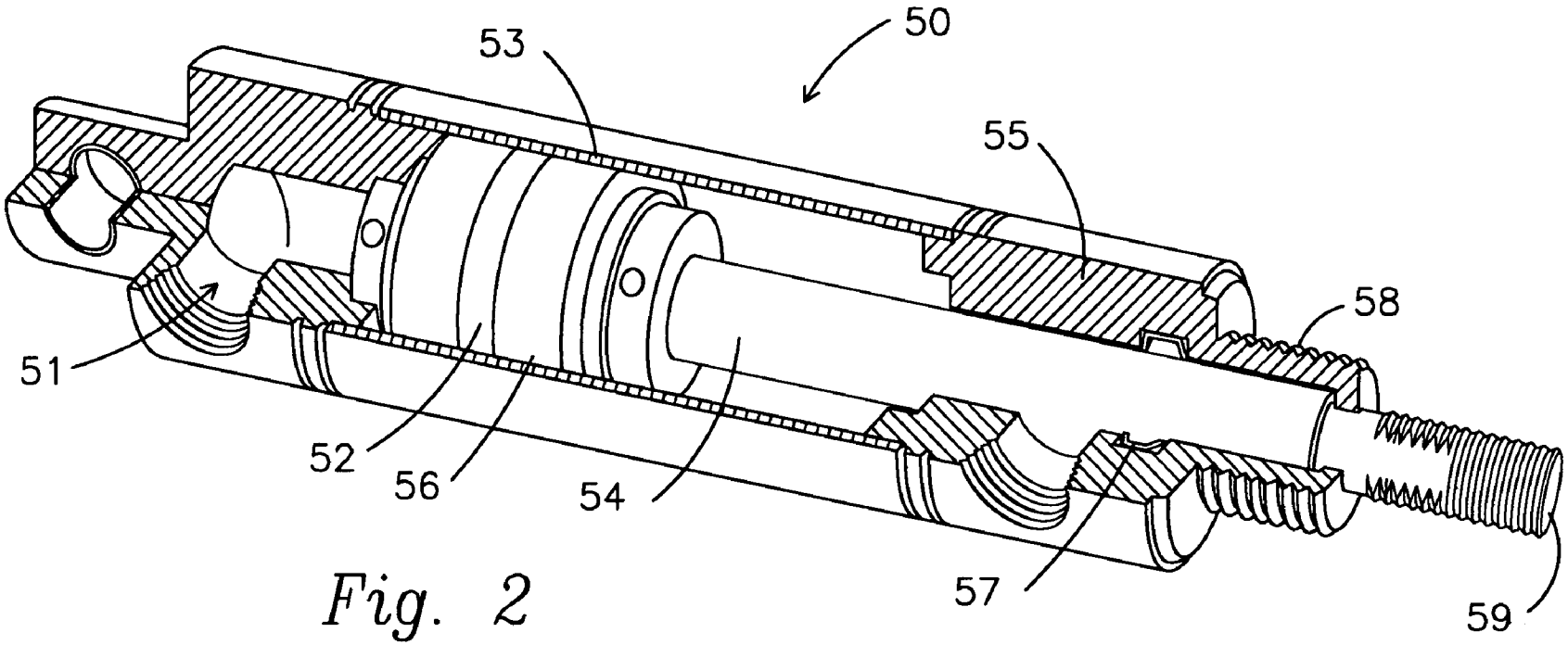
FIG. 2 is a sectional view of a representative pneumatic cylinder that may be adapted for use in the present invention.

Central to the operation of gated loopers is the use of pneumatic cylinders 50 as shown in FIG. 2. Cylinder 50 has a rear portion with inlet opening 51 to receive pressurized gas, cylinder wall 53 defining a cylinder in which piston 52 may move reciprocally, and head 55 which stops the forward movement of piston 52 in response to the pneumatic force of the pressurized gas. A drive rod 54 extends from the piston 52 forward and out through the head 55 to a rod tip 59. Piston seals 56 and rod seals 57 help insure the smooth movement of piston 52 within the cylinder without excess loss of pneumatic force. The tip 58 of head 55 is preferably threaded to enhance the ease of securely mounting cylinder 50. Clippard Model EP2064-P10 air cylinders are the preferred pneumatic cylinders to utilize to practice the invention.

FIGS. 3 and 4 show a first embodiment of a sliding gate mechanism according to the invention. Pneumatic cylinders 50 are mounted to the rear of apertures 73 extending through rear mounting plate 61. The forward ends 59 of rods 54 of pneumatic cylinders 50 engage with the rear of the sliders 75*a*, 75*b*, 75*c*, 75*d*. Sliders 75 extend forward to detents 74, through springs 70 and into slots 77. Because cylinders 50 and sliders 75 are configured on four levels, upon entering slots 77, the sliders 75 engage with a translation section such as compensating plates 78 in order that movement imparted by drive rods to sliders 75 will be translated to a plane of motion approximate the bottom of hook bills 42. Compensating plates 78 engage looper clips 67 so that forward motion imparted by rod 54 is communicated to slider bar 75 and via compensating plate 78 to looper clip 67 which causes looper clip front end 68 to close the lip formed by the hook bill 42 of a corresponding hook 41. When pneumatic pressure is released from cylinder 50, the action of spring 70 pushing against front mounting plate 62 and detent 74 moves all of rod 54, slider 75, compensating plate 78, and looper clip 67 rearward which again exposes the lip of loop hook 41 formed by hook bill 42.

Figure 3A:
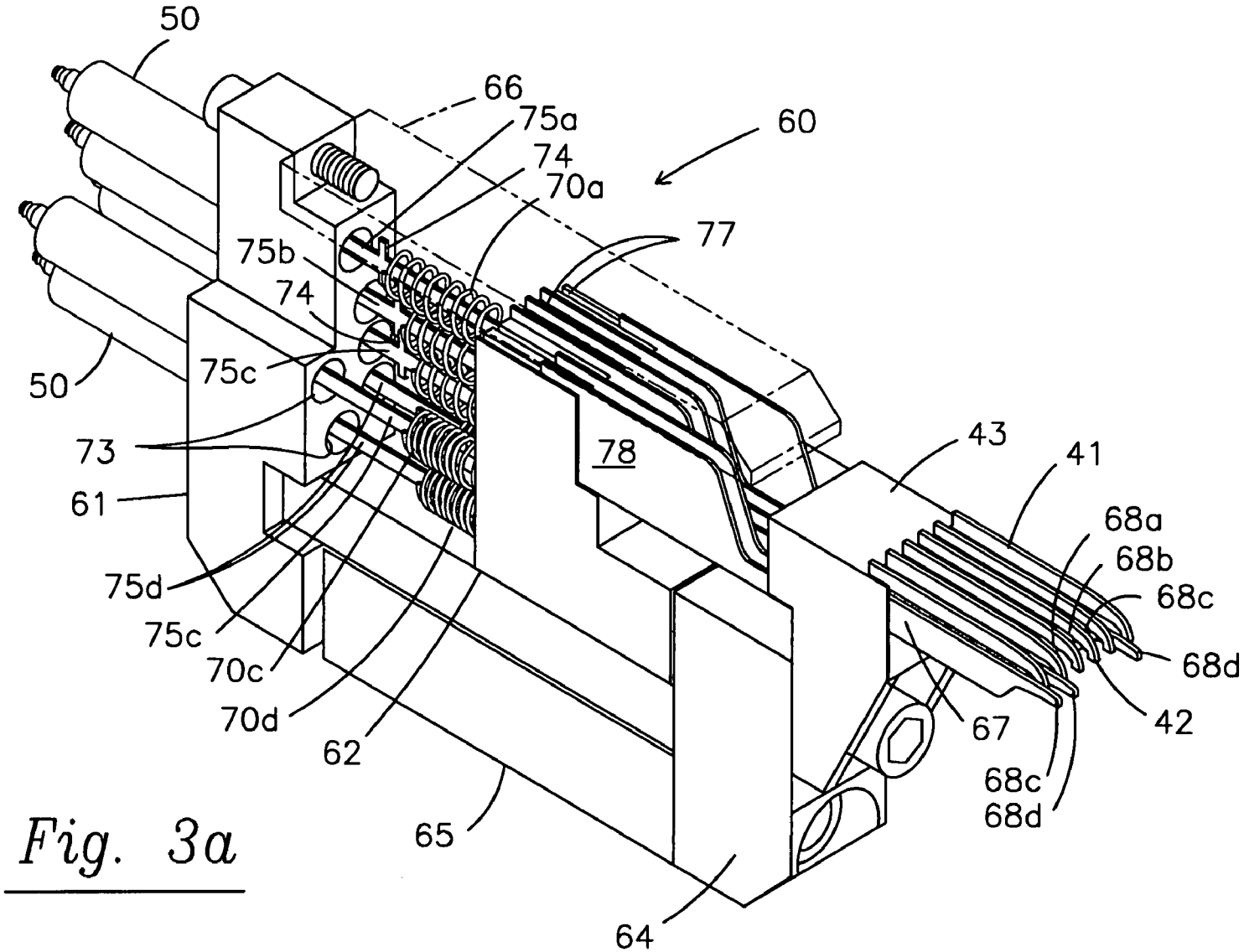
FIG. 3A is a perspective partial sectional view of an embodiment of two columns of four cylinders and the corresponding gates and loopers according to the present invention.
Figure 3B:
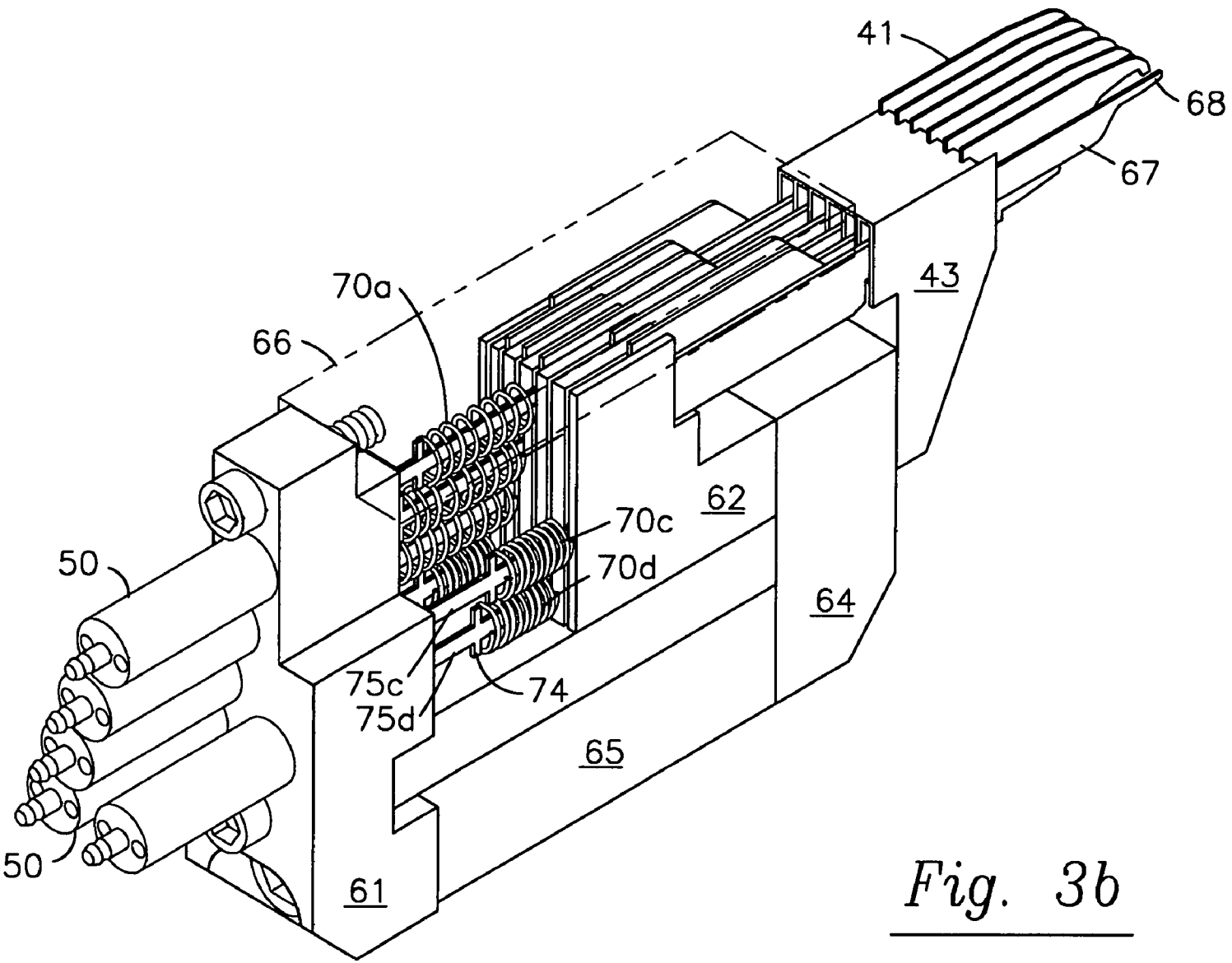
FIG. 3B is a rear perspective view of the assembly of FIG. 3A.

In FIG. 3A, it can be seen that cylinders 50 corresponding to slider 75*c* and 75*d* are activated so that pistons 52 have pushed rods 54 forward thereby pushing sliders 75*c*, 75*d* forward and compressing springs 70*c* and 70*d*. The corresponding compensating plates 78 are pushed forward, as are the looper clip fronts 68*c* and 68*d*. FIG. 3B shows the reverse angle view of the same configuration. Accordingly, in this configuration when loop hooks 41 rock forward to seize loops of yarn from needles 14, the loops of yarn seized on the first two hooks covered by looper clip fronts 68*c*, 68*d* will be seized and released while the yarns seized by hooks with hook bills not closed by sliders 68*a* and 68*b* will be retained on the lips formed by hook bills 42 and ultimately dragged into contact with knives 36 (shown in FIG. 1) where the loops of yarn will be cut. Thus, loops of yarn seized over closed gated hooks will form loop pile bights and loops of yarn seized over open gated hooks will form cut pile bights of yarn on the face 45 of the carpet.

Figure 4A:
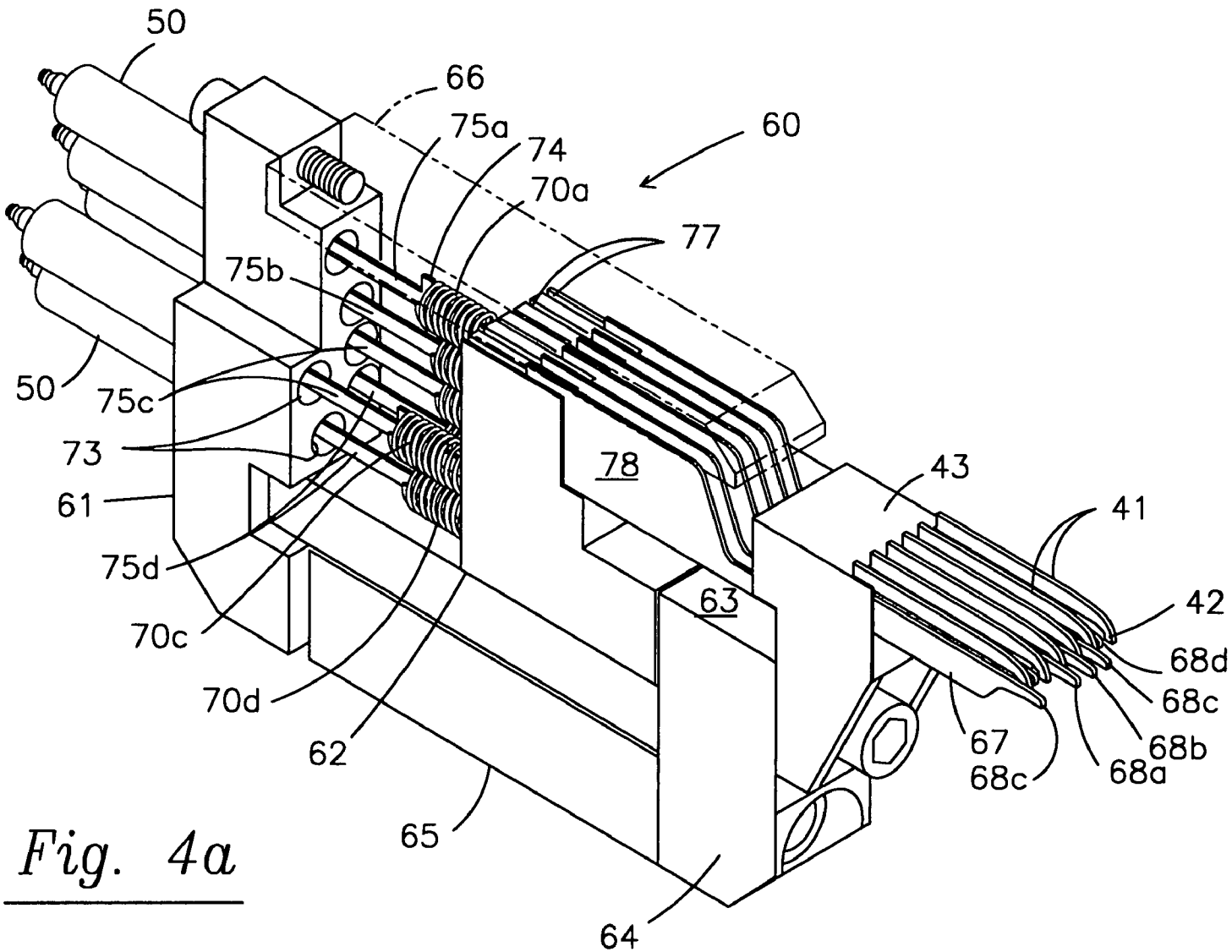
FIG. 4A is a perspective partial sectional view of an embodiment of two columns of four cylinders and the corresponding gates and loopers according to the present invention.
Figure 4B:
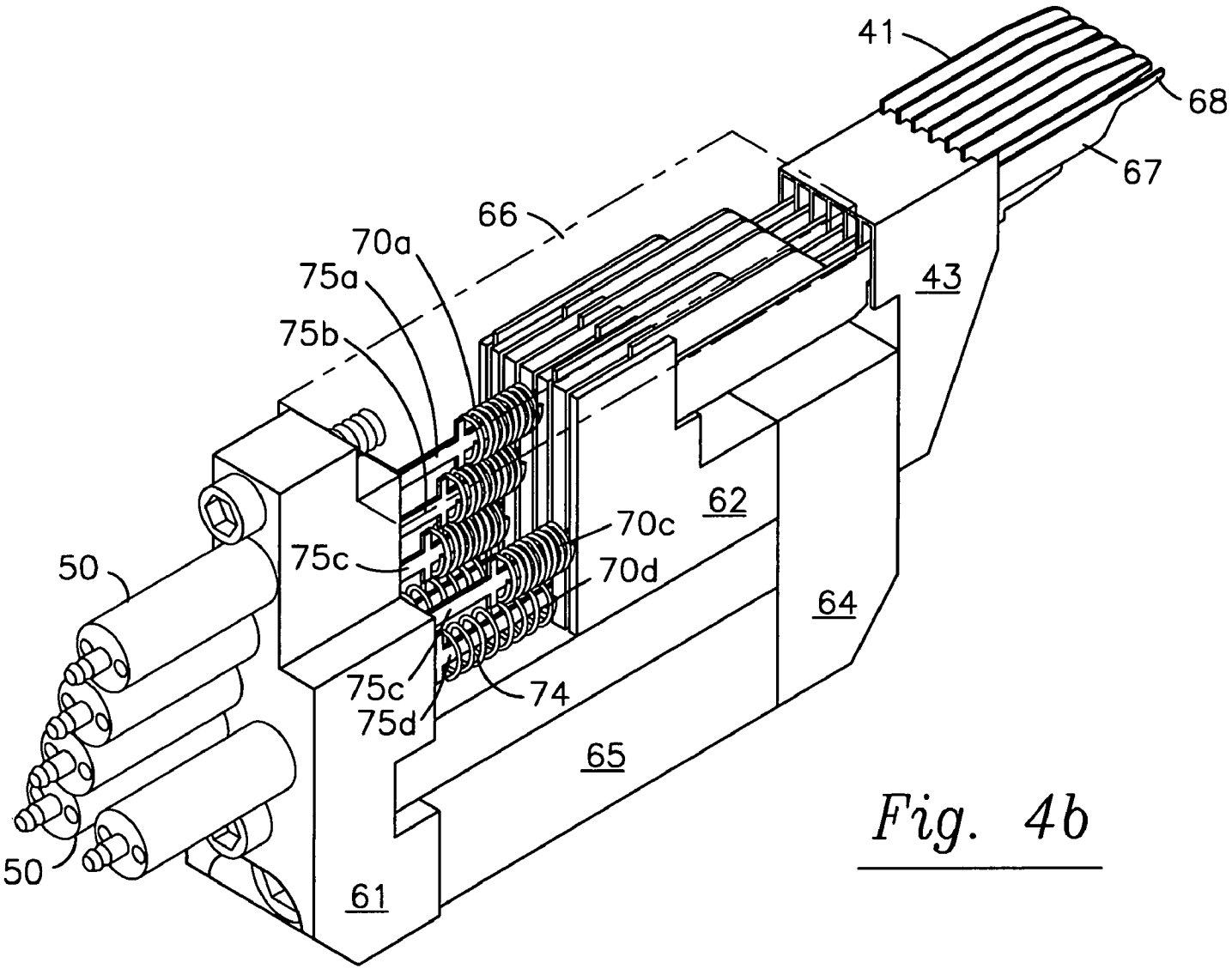
FIG. 4B is a rear perspective view of the assembly of FIG. 4A.

FIG. 4A shows the same configuration of pneumatic cylinders 50, slider bars 75, compensating plates 78, and looper clips 67. However, in the illustrated configuration, it is sliders 75*a*, 75*b* and both sliders 75*c* that are activated by pneumatic pressure in corresponding cylinders 50 thereby closing the lips corresponding to hooks 41 that are matched with looper clip fronts 68*c*, 68*a* and 68*b*. Thus, a stitch tufted with yarns seized by the six illustrated loopers will tuft four loop pile bights and two cut pile bights. FIG. 4B is a reverse angle illustration of the same configuration. Because the pattern of gated and ungated hooks can be changed with each stitch of the tufting machine, a wide variety of patterns of loop and cut pile bights of yarn may be produced. Because the springs 70 are not placed within cylinders 50 to act upon pistons 52 but instead are placed about the slider bars 75, not only is it possible to use larger and more powerful springs, but any deterioration of spring function can be readily observed, and springs are not susceptible to retained moisture and rusting inside a confined cylinder space. The use of more powerful springs 70 provides faster return response to reopen the gated hooks at the conclusion of a stitch cycle, and permits faster operation of the tufting machine.

FIGS. 5 and 6 show an alternative preferred construction of gated loopers of the present invention. In this instance, rather than using slots 77 and compensating plates 78 to translate the movement of the cylinder rods 54 into the plane of the looper clips 67, sliders 75 are constructed with a rear combination rod tip engaging portion 72 and detent, proceeding to a relatively straight spring bearing portion, then to a translation portion, and finally to a forward hook portion 71. Forward hook portions 71 are designed to engage with rear hook portions 69 of looper clips 67. The slider bars 75*a* connecting with pneumatic cylinders 50 are positioned along the top of the array of pneumatic cylinders in a four by eighteen configuration as illustrated in FIG. 5, translate the motion imparted by piston rods 54 downward as shown in slider bar 75*a*. Similarly, the slider bar 75*d* which engages with a pneumatic cylinder at the bottom of the array translates the motion imparted by piston rod 54 upward. In the illustrated embodiment, the slider bars 75*b* and 75*c* which translate motion from piston rods 54 of intermediate rows of pneumatic cylinders translate that motion slightly downward, but less so than by the slider bars 75*a* for the cylinders 50 placed at the top of the array.

Pneumatic cylinders 50 have their threaded heads 58 fixed in rear openings 73 of rear mounting plate 61. Piston rod ends 59 engage with slider bar rear tip engaging portions 72 which are received into the forward openings of apertures 73 of the rear mounting plate. The translation and front tip 71 portions of slider bar 75 extend forward through apertures 79 in front mounting plate 62. On the relatively straight portions of the slider bars 75 intermediate front and rear mounting plates 61, 62 are mounted springs 70. Slider tips 71 have upward facing lips that engage with downward facing lips of the rear 69 of looper clips 67, such engagement preferably being within slots of clip guard 63. Looper clips 67 extend forward into slots within hook blocks 73 so that a looper clip front end or gate 68 is adjacent to each hook 41 in the block. Pneumatic pressure applied to a cylinder 50 causes the piston rod 54 and corresponding rod end 59 to move forward thereby pushing corresponding slider ends 72 and sliders 75 with front end 71 forward and compressing the springs 70 on any activated slider 75 against the front mounting plate 62. Slider front 71 pushes corresponding looper clip rear end 69 and looper clip 67 with gate 68 forward to cause gate 68 to cover the lip formed by hook bill 42 of its adjacent hook 41. When pneumatic pressure in cylinder 50 is relaxed, the biasing force of compressed spring 70 on the activated slider bar 75 tends to return the looper clip 67, slider bar 75 and piston rod 54 to their original positions, again opening the lips formed by the hook bills 42 and permitting yarns to be seized on the hooks 41 and brought into contact with an associated knife 36.

Again, the placement of spring 70 external the slider bar 75 rather than internal the pneumatic cylinder 50 permits the use of more powerful springs and reduces maintenance issues associated with a gated looper apparatus. Furthermore, the use of individually attached cylinders 50 permits defective cylinders or other defective components to be replaced individually rather than requiring replacement of an entire array of components. This facilitates product service and reduces maintenance costs for both parts and labor. Front and rear mounting plates 61, 62 are positioned by spacer bolts 81 affixed in threaded apertures on the rear of front mounting plate 62 and extending rearward and bolts 80 extending through washers 82 and apertures in rear mounting plate and are received within spacer bolts 81. Housing 66 is secured by bolts 83 through apertures 84 in the tops of front and rear mounting plates 61, 62. The face 45 of tufted carpet may pass over housing 66 without interfering in any way with the operation of the gated looper apparatus.

The control of the pneumatic cylinders 50 and thus the gates 68 is preferably accomplished by a computer controlled array of valves with the number of valves corresponding to the number of cylinders, so that each hook 41 in a tufting machine and its corresponding looper clip 67 is controlled individually. In response to signals from the computer or controller, valves open and close communication between a compressor and air conduits communicating from the valves to each cylinder 50 in the arrays. When a valve is closed to prevent communication of pressurized air to a corresponding cylinder 50, the valve vents the pressurized air so that spring 70 may return the gate apparatus to its inactivated open form, in which case the associated hook will tuft cut pile bights of yarn.

The guideway 43 is preferably made of aluminum which, in comparison to steel, will remove between about 35 to 60 pounds of weight from the looper apparatus over a 165" to 195" wide tufting machine. Additional weight savings are accomplished by utilizing aluminum and other lightweight metals for base 65 and support base 64. By removing over 100 pounds of weight from the reciprocating looper apparatus, the tufting machine is subject to less vibration during operation and can be run at higher speeds.

Figure 7:
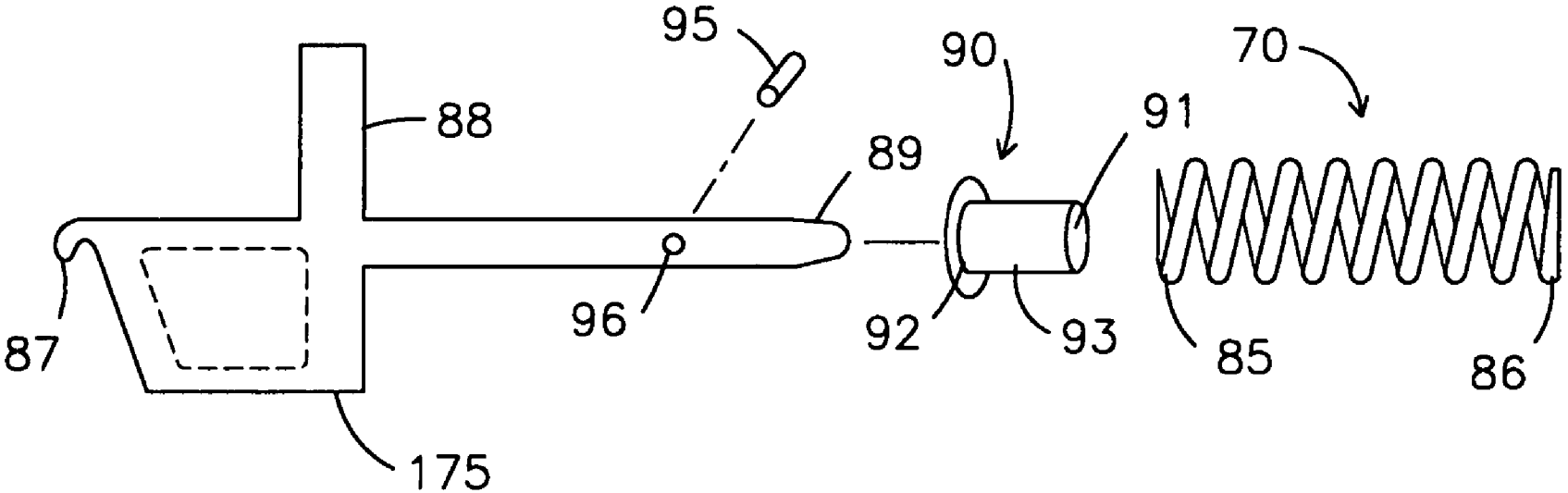
FIG. 7 is a detailed exploded view of a slider and biasing spring according to a preferred embodiment of the invention.

A preferred slider and biasing spring is shown in FIG. 7 with slider 175 having a front end 87 for translating motion to looper clips 67 and rear end 89 for engaging with drive rods of pneumatic cylinders. Over the rear end 89 is mounted ferule 90 having a base flange 92, body 93 and lumen 91 to receive slider end 89. A preferred biasing spring 70 preferably has a slightly tapered configuration from forward end 85 that rests on the base flange 92 to rearward end 86 and the pitch of the spring 70 is slightly less at the forward end. Forward end 85 fits over body 93 of ferule 90 and spring 70 is restrained in place on the slider 175 by a detent, here created by the insertion of pin 95 through aperture 96 at the rearward end 89 of slider 75. The lessened pitch of spring 70 causes less deformation of the spring through the many repetitive cycles of compression and expansion. In addition ferule 90 protects spring 70 from uneven wear from repeated friction on the rearward end of slider 75. Additional weight savings may also be accomplished by cut outs in slider 175 as shown in phantom.

Figure 8A:
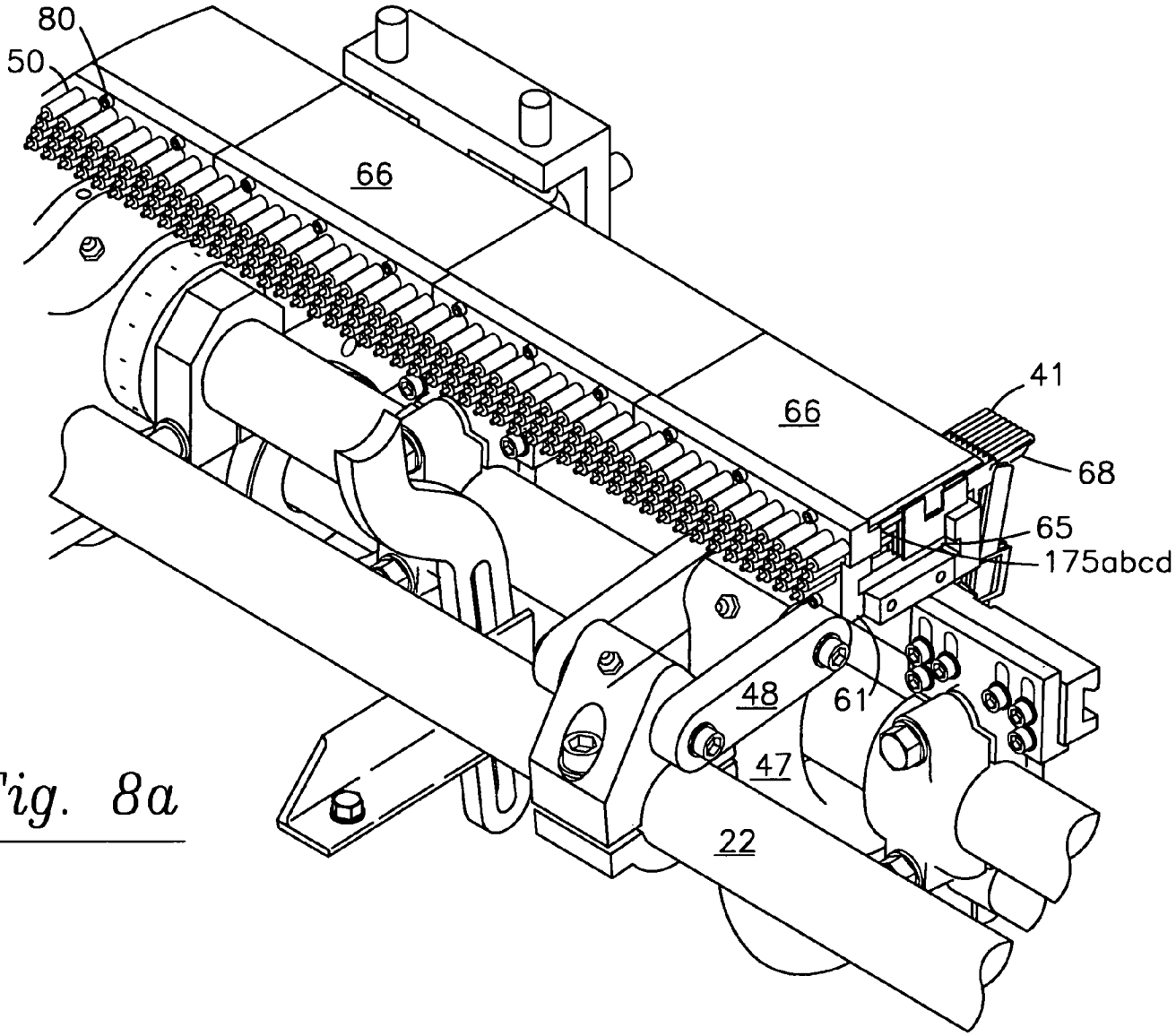
FIG. 8A is another embodiment of the invention in perspective view on the rocker bar.
Figure 8B:
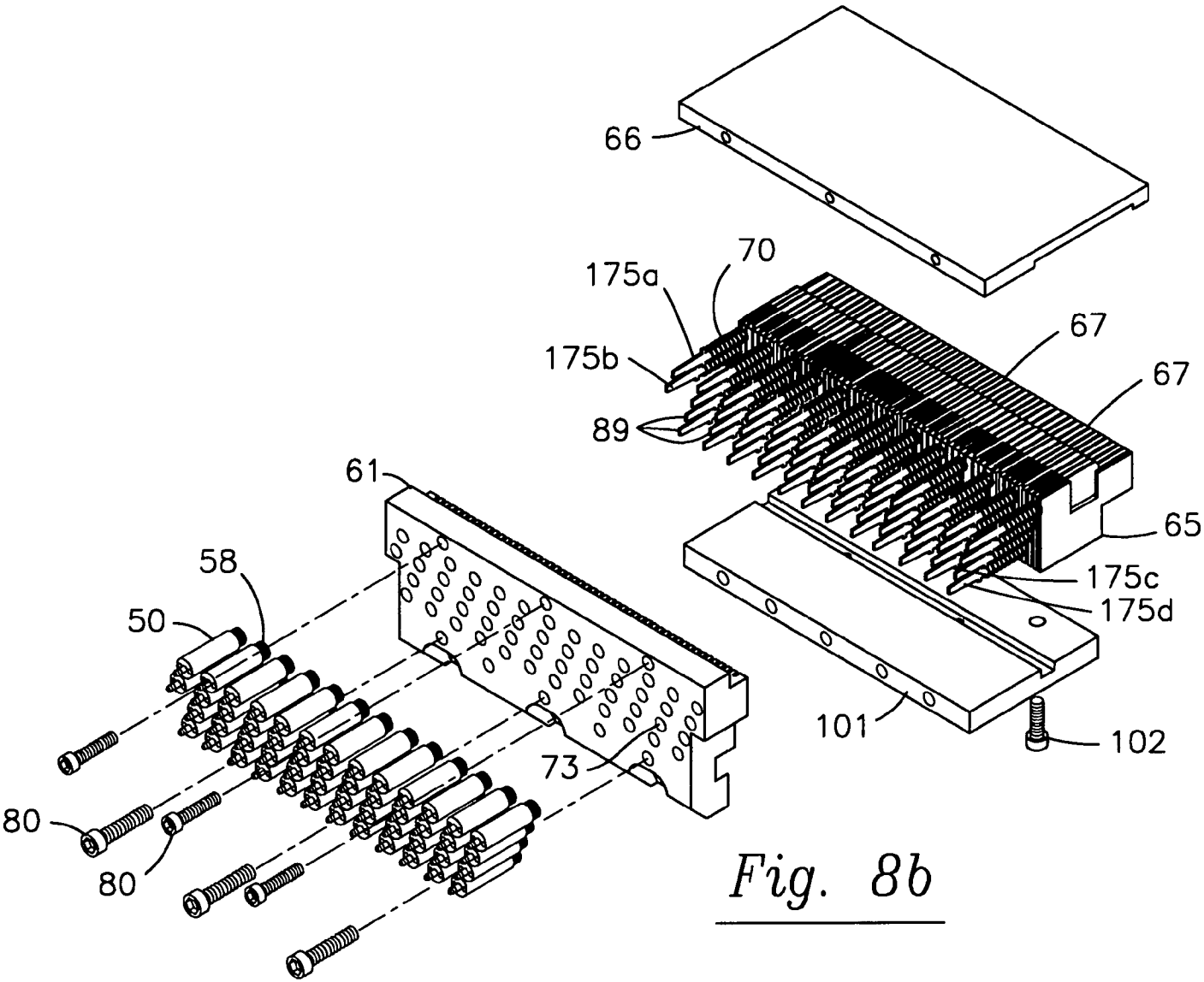
FIG. 8B is an exploded perspective view of the cylinder and slider assembly of the embodiment of FIG. 8A.

FIG. 8A shows an alternative embodiment of the invention in which the columns of cylinders are stacked at a slight angle to the vertical. These are referred to as substantially vertical offset columns. In this fashion, it is not necessary to have a transition section as is required when the column of cylinders 50 is entirely vertical. Cylinders 50 are screwed into openings on rear mounting plate which covers sliders 175*a*, 175*b*, 175*c*, 175*d* each configured with slightly different rear portion to connect at the appropriate height to the forward ends 59 of pneumatic cylinders 50 at an appropriate height. Sliders 175*a*, 175*b*, 175*c*, 175*d* engage with the rear of looper clips 68 within guideway 65. The slider connections are covered by housing cover 66 which helps direct tufted fabric over the pneumatic gated looper assembly. An exploded view of the structure is shown in FIG. 8B more clearly showing a different rear end 89 positioning of sliders 175*a*, 175*b*, 175*c*, 175*d*.

Although preferred embodiments of the present invention have been disclosed in detail herein, it will be understood that various substitutions and modifications may be made to the disclosed embodiment described herein without departing from the scope and spirit of the present invention as recited in the appended claims.

I claim:

1. A gated looper apparatus for use in a tufting machine comprising an array of pneumatic cylinders individually mounted to apertures of a rear mounting plate, each pneumatic cylinder having a piston rod responsive to pressure applied to the pneumatic cylinder to cause an associated rearwardly biased slider to move forward, thereby moving an associated gate forward and covering the hook bill of an associated hook; wherein the slider is biased by an external biasing force acting upon a detent on the slider.

2. The gated looper apparatus of claim 1 wherein the external biasing force is a spring mounted on the slider.

3. The gated looper apparatus of claim 2 wherein a ferrule is mounted on the slider under at least a portion of the spring.

4. The gated looper apparatus of claim 1 wherein the array of pneumatic cylinders comprises vertical columns of at least three cylinders.

5. The gated looper apparatus of claim 1 wherein the array of pneumatic cylinders comprises substantially vertical offset columns of at least three cylinders.

6. The gated looper apparatus of claim 1 wherein the gate is the forward end of a looper clip and the rear end of said looper clip connects to an element in communication with the pneumatic cylinder in a slot of a guideway.

7. The gated looper apparatus of claim 6 wherein the guideway is fabricated of aluminium.

8. A slider for use in a gated looper apparatus in a tufting machine comprising a forward end for translating motion to gates and a rear end for communication with the drive rod of a pneumatic cylinder and a body between said forward end and rear end, wherein a spring is received over the rear end, and held in place between the rear end and the body by a detent.

9. The slider of claim 8 wherein ferrule is mounted on the rear end of the slider beneath at least a part of the spring.

10. The slider of claim 8 wherein a portion of the body is cut out.

11. The slider of claim 8 wherein the spring is tapered from a larger portion at its forward end to a smaller portion at its rearward end.

12. The slider of claim 8 wherein the pitch of the spring is less toward its forward end.

13. A gated looper apparatus for use in a tufting machine comprising:

a) a plurality of transversely spaced hooks having bills at their forward ends, said bills forming lips thereunder;

b) a plurality of transversely spaced looper clips, each looper clip being associated with a hook and being slideable between a forward lip covering position and a rear open position;

c) a plurality of transversely spaced sliders having rear ends and having forward ends for communicating movement to a looper clip;

d) a plurality of springs received over the rear ends of the transversely spaced sliders;

e) an array of pneumatic cylinders having drive rods to communicate movement to the rear ends of the sliders.

14. The gated looper apparatus of claim 13 wherein a ferrule is mounted on the slider under at least a portion of the spring.

15. The gated looper apparatus of claim 13 wherein the array of pneumatic cylinders comprises vertical columns of at least three cylinders.

16. The gated looper apparatus of claim 13 wherein the array of pneumatic cylinders comprises substantially vertical offset columns of at least three cylinders.

17. The gated looper apparatus of claim 13 wherein each of said looper clips has a rear end connecting to the forward end of a slider in a slot of a guideway.

18. The gated looper apparatus of claim 13 wherein a translation section is used to align the movement of a drive rod with the plane of motion of a looper clip in a slot of the guideway.

19. The gated looper apparatus of claim 17 wherein the guideway is fabricated of aluminium.

20. The gated looper apparatus of claim 13 the plurality of springs are tapered from a larger portion at their forward ends with less pitch to a smaller portion at its rearward end.

* * * * *